United States Patent [19]

Häseler et al.

[11] 4,264,717

[45] Apr. 28, 1981

[54] COLOR PHOTOGRAPHIC MATERIAL AND COLOR PHOTOGRAPHIC PROCESSES

[75] Inventors: Helmut Häseler; Fritz Nittel, both of Leverkusen, Fed. Rep. of Germany

[73] Assignee: AGFA-Gevaert, A.G., Leverkusen, Fed. Rep. of Germany

[21] Appl. No.: 85,485

[22] Filed: Oct. 17, 1979

[30] Foreign Application Priority Data

Oct. 21, 1978 [DE] Fed. Rep. of Germany ..... 2845907

[51] Int. Cl.[3] ..... G03C 5/30

[52] U.S. Cl. ..... 430/469; 430/484; 430/487; 430/377; 430/564

[58] Field of Search ..... 430/467, 469, 487, 493, 430/357, 484, 564, 377

[56] References Cited

U.S. PATENT DOCUMENTS

| | | | |
|---|---|---|---|
| 3,128,182 | 4/1964 | Bard | 430/469 |
| 3,380,828 | 4/1968 | Kitze | 430/405 |
| 3,619,198 | 11/1971 | Yamamoto | 430/599 |
| 3,640,721 | 2/1972 | Ishihara et al. | 430/638 |

OTHER PUBLICATIONS

Research Disclosure, Sep. 1975 #13748 p. 34.

*Primary Examiner*—Mary F. Downey

[57] ABSTRACT

Compounds of the formula

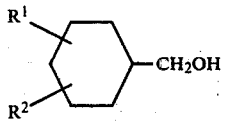

are useful in photographic materials and processes for the color development.

5 Claims, No Drawings

COLOR PHOTOGRAPHIC MATERIAL AND COLOR PHOTOGRAPHIC PROCESSES

This invention relates to a colour photographic material, to a bath for colour development and to processes for the colour development of colour photographic materials and for the production of colour images. It is known to carry out imagewise exposure of colour photographic materials which have at least one light-sensitive silver halide emulsion layer and to develop them with a colour developer. The colour photographic material generally contains at least three light-sensitive emulsion layers which may contain the usual colour couplers. Colour development is generally carried out using a colour developer which contains a compound based on p-phenylenediamine series as colour developer substance.

It is known to speed up colour development by the addition of so-called development accelerators. Compounds which have been described as such development accelerators include e.g. those with an onium structure, e.g. quaternary ammonium, phosphonium and ternary sulphonium salts, and polyalkylene oxides. It is also known, in particular, to add amine compounds or alcohols to the colour developers. In particular, it is known to add aralkyl alcohols to the colour developers as development accelerators, in particular benzyl alcohol as described in U.S. Pat. No. 2,304,925.

One disadvantage of using such aralkyl alcohols is their low solubility in aqueous solutions. It is known from German Offenlegungsschrift No. 2,648,839 that this causes the formation of oil droplets in colour developers which contain aralkyl alcohols. This leads to processing faults, due particularly to hydrophobic developer substances concentrating in these oil droplets, and the sensitometric results are impaired.

It is an object of the present invention to improve the sensitometric results obtained in the colour development of colour photographic materials.

It has been found that the colour development of colour photographic materials is accelerated in a suitable manner by cyclohexane compounds corresponding to the following general formula (I):

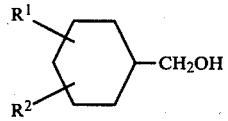

in which $R^1$ represents OH or —$CH_2$—OH and $R^2$ represents H; or $CH_3$ when $R^1$=OH.

The substituents $R^1$ and $R^2$ may be located in any position on the cyclohexane ring.

The invention also provides a process for the development of colour photographic materials having at least one light-sensitive silver halide emulsion layer by means of a colour developer based on p-phenylenediamine, in which colour development is carried out in the presence of at least one compound corresponding to the general formula given above.

The invention also provides a process for the production of colour photographic images by exposure and development of a light-sensitive colour photographic recording material having at least one silver halide emulsion layer, in which development is carried out in the presence of at least one compound of the given general formula.

The invention further provides a colour photographic material having a least one light-sensitive silver halide emulsion layer, which material contains at least one compound of the given general formula, and a bath for the colour development of colour photographic materials, containing at least one developer compound based on p-phenylenediamine and at least one compound of the given general formula.

The development accelerators to be used according to the invention are organic compounds which are readily miscible with water and they increase the sensitometric sensitivity and colour yield of colour photographic materials. Suitable compounds of formula (I) may correspond, for example, to the following structure:

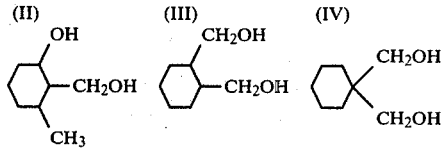

A particularly suitable compound is p-bis-hydroxymethylcyclohexane corresponding to the folowing formula:

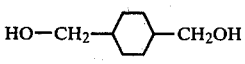

(V)

Methods of preparing these compounds are known and have been described, for example, in Beilstein, 6 H/E III, pages 4097 et seq.

The development accelerators to be used according to the invention are suitable for all silver halide emulsions. The silver halide in these emulsions may be silver bromide, silver chloride or mixtures thereof, which may have a silver iodide content of up to 10 mol%.

The colour photographic materials used may be developed with the usual colour developer substances, e.g. N,N-dimethyl-p-phenylenediamine; 4-amino-3-methyl-N-ethyl-N-methoxyethylaniline; 2-amine-5-diethylaminotoluene; N-butyl N-ω-sulphobutyl-p-phenylenediamine; 2-amino-5-(N-ethyl-N-β-methanesulphonamidoethyl-amino)-toluene; N-ethyl-N-β-hydroxyethyl-p-phenylenediamine; N,N-bis-(β-hydroxyethyl)-p-phenylenediamine and 2-amino-5-(N-ethyl-N-β-hydroxyethylamino)-toluene. Other suitable colour developers have been described, for example, in J. Amer. Chem. Soc. 73, 3100 (1951).

The colour photographic material used may contain the usual colour couplers, and these may be incorporated directly in the silver halide layers. Examples of suitable colour couplers may be found in the publication entitled "Farbkuppler" by W. Pelz in "Mitteilungen aus den Forschungslaboratorien der Agfa, Leverkusen/-Munchen", Volume III (1961) and in "The chemistry of Synthetic Dyes", by K Venkataraman, Vol. 4, 341 to 387, Academic Press, 1971. 2-Equivalent couplers may also be used as non-diffusible colour couplers, for example the known DIR couplers.

The colour couplers may be added to the light-sensitive silver halide emulsions or other casting solutions by the usual known methods. If the compounds are insoluble in water or alkalies, they may be emulsified in known manner. So-called coupler solvents or oil formers may, if indicated, be added for the emulsification of such hydrophobic compounds; as is described for example, in U.S. Pat. Nos. 2,322,027; 2,533,514; 3,689,271; 3,764,336 and 3,765,897.

The binder used for the photograhic layers is preferably gelatin although this may be partly or completely replaced by other natural or synthetic binders.

The emulsions may also be chemically sensitized, for example by the addition of sulphur compounds during chemical ripening, for example allyl isothiocyanate, allylthiourea or sodium thiosulphate. Reducing agents may also be used as chemical sensitizers, e.g. the tin compounds described in Belgian Pat. Nos. 493,464 and 568,687, polyamines such as diethylenetriamine or aminomethylsulphinic acid derivatives, e.g. according to Belgian Pat. No. 547,323. Noble metals such as gold, platinum, palladium, iridium, ruthenium or rhodium and compounds of these metals may also be used as chemical sensitizers. The emulsions may also be sensitized with polyalkylene oxide derivatives, e.g. with a polyethylene oxide having a molecular weight from 1000 to 20,000, or with condensation products of alkylene oxides and alcohols, aliphatic carboxylic acids, aliphatic amines aliphatic diamines and amides.

The emulsions may also be optically sensitized, e.g. with the usual polymethine dyes such as neutrocyanines, basic or acid carbocyanines, rhodacyanines, hemicyanines, styryl dyes and oxonoles. Sensitizers of this type have been described in the work by F. M. Hamer, "The Cyanine Dyes and related Compounds", (1964).

The emulsions may in addition contain the usual stabilizers, e.g. homopolar or salt-type compounds of mercury containing aromatic or heterocyclic rings, such as mercapto triazoles, or simple mercury salts, sulphonium mercury double salts or other mercury compounds. Azaindenes are also suitable stabilizers, particularly tetra- and penta-azaindenes and especially those which are substituted with hydroxyl or amino groups. Compounds of this type have been described in the article by Birr, Z. Wiss Phot. 47 (1952), 2 to 58. Other suitable stabilizers include inter alia heterocyclic mercapto compounds, e.g. phenylmercaptotetrazole, quaternary benzothiazole derivatives and benzotriazole.

The emulsion may be hardened in the usual manner, for example with formaldehyde or halogen substituted aldehydes which contain a carboxy group, such as mucrobromic acid, diketones, methanesulphonic acid esters and dialdehydes. The photographic layers may also be hardened with epoxide, heterocyclic ethyleneimine or acryloyl type hardeners. The layers may also be hardened by the process according to German Offenlegungsschrift No. 2,218,009 to produce colour photographic materials which are suitable for high temperature processing. The photographic layers or colour photographic multilayered materials may also be hardened with hardeners based on diazine, triazine or 1,2-dihydroquinoline. Examples of such hardeners include diazine derivatives containing alkylsulphonyl or arylsulphonyl groups, derivatives or hydrogenated diazines or triazines, e.g. 1,3,5-hexahydrotriazine, fluorosubstituted diazine derivatives, e.g. fluoropyrimidine; and esters of 2-substituted 1,2-dihydroquinoline-or 1,2-dihydroisoquinoline-N-carboxylic acids. Also suitable are the vinyl sulphonic acid hardeners and carbodiimide and carbamoyl hardeners as described e.g. in German Offenlegungsschrifften Nos. 2,263,602; 2,225,230 and 1,808,685; French Pat. No. 1,491,807, German Pat. No. 872,153 and DDR Pat. No. 7218. Other suitable hardeners have been described, for example, in British Pat. No. 1,268,550.

The development accelerators according to formula I may be added to the colour photographic materials, e.g. to the light sensitive silver halide emulsions. The accelerators may, of course, also be added to other photographic layers. The concentration of development accelerator in the emulsion may vary over a wide range. It depends on the nature of the emulsion and the desired effect. Quantities of from 40 g to 600 g, in particular from 150 g to 300 g, per mol of silver halide may generally be used.

The development accelerators to be used according to the invention are preferably added to the colour developer. The concentration of development accelerator may be varied within wide limits and is advantageously in the range from 0.1 g to 100 g per liter, in particular from 1 g to 40 g per liter. The colour developers may also contain the usual other constituents, in particular also other development accelerators.

Colour development may be carried out within a wide temperature range, for example from 20° to 60° C., in particular also above 30° C.

The development accelerators to be used according to the invention may be used for the colour development of colour photographic materials which contain hydrophilic or hydrophobic colour couplers or both hydrophilic and hydrophobic colour couplers. The use of colour couplers which are emulsified in the hydrophobic form simultaneously with water-soluble or alkali-soluble colour couplers in one and the same material is known and is described for example in German Offenlegungsschrift No. 1,962,606; German Auslegeschrift No. 1,547,816, British Pat. No. 1,107,453 and U.S. Pat. No. 3,515,557. Both hydrophobic and hydrophilic colour developer substances and mixtures thereof may be used. Hydrophobic and hydrophilic colour developer substances have been described, for example, in German Patent Application P 28 33 655.2.

The Development accelerators to be used according to the invention are particularly advantageous when at least one colour coupler is in the hydrophilic form or when at least one hydrophilic colour developer substance is used.

EXAMPLE 1

The following layers were applied in succession to a polyethylene coated paper substrate to produce a light sensitive colour photographic material:

(a) Yellow layer, containing an emulsion of 97.8 mol % bromide, 2 mol.% chloride and 0.2 mol iodide which is sensitive to the blue spectral region and a colour coupler corresponding to the following formula:

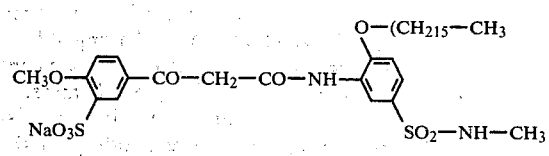

Silver application corresponding to 0.8 g $AgNO_3/m^2$.

(b) Magenta layer containing an emulsion of 84.5 mol % bromide, 15 mol % chloride and 0.5 mol % iodide which is sensitized to the green spectral region and a colour coupler corresponding to the following formula:

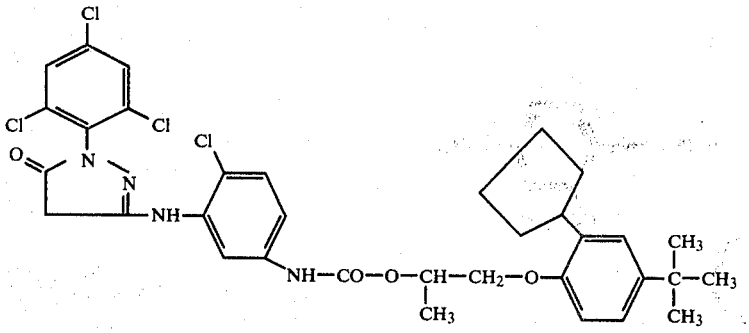

Silver application corresponding to 0.8 g $AgNO_3/m^2$.

(c) Cyan layer containing an emulsion of 79 mol % bromide, 20 mol % chloride and 1 mol % iodide which is sensitized to the red spectral region and a colour coupler corresponding to the following formula:

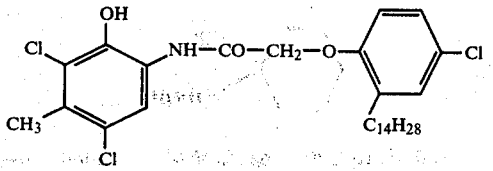

Silver application corresponding to 0.6 g $AgNO_3/m^2$.

The couplers in the magenta and cyan layer were emulsified in known manner with an oil former corresponding to the following formula:

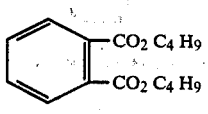

The finished material was exposed imagewise and then processed as follows:

| | | |
|---|---|---|
| Colour development | 2 min | 37° C. |
| Short stop bath | 1 min | 20° C. |
| Washing | 1 min | 20° C. |
| Bleach fix bath | 3 min | 20° C. |
| Washing | 3 min | 20° C. |

Colour development is carried out alternatively in colour developers I and II having the composition indicated below. The other baths have the usual composition.

COLOUR DEVELOPER I (QUANTITIES PER LITER)

| | |
|---|---|
| Sodium nitrilotriacetate | 2 g |
| Hydroxylammonium Sulphate | 3 g |
| Sodium sulphite sicc. | 3 g |
| Potassium bromide | 0.9 g |
| N-butyl-N-ω-sulphobutyl-p-phenylenediamine | 4 g |
| Potash | 35 g |
| Additive (see Table 1) | |

COLOUR DEVELOPER II

The composition is the same as that of colour developer I except that in this case 4-amino-N-ethyl-N-(β-methanesulphonamidoethyl)-m-toluidine is used in place of N-butyl-N-ω-sulphobutyl-p-phenylenediamine.

The following substances were used as additives to the colour developer in quantities of 20 ml per liter of colour developer:

(a) 1,4-Bis-hydroxymethylcyclohexane (abbreviated: BHMCH)

(b) tetraethyleneglycol (abbreviated: TAG).

The sensitometric data obtained from colour separation measurements are summarized in Table 1 below.

TABLE 1

| | Maximum density | | | | | |
|---|---|---|---|---|---|---|
| | Developer I | | | Developer II | | |
| Additive | Yellow | Magenta | Cyan | Yellow | Magenta | Cyan |
| No additive | Type | Type | Type | Type | Type | Type |
| BHMCH | +53% | +13% | +58% | +23% | +5% | ±0 |
| TAG | −6% | ±0 | ±0 | +7% | +2% | ±0 |

Table 1 shows that distinctly higher colour densities are obtained by adding the compound to be used according to the invention (BHMCH).

EXAMPLE 2

A colour photographic material is prepared, exposed and processed as described in Example 1, but a coupler corresponding to the following formula is used in the blue sensitive yellow layer instead of that used in Example 1:

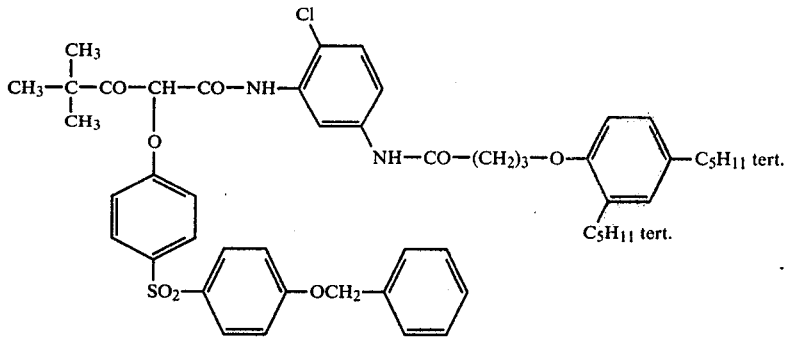

The sensitometric values obtained are shown in Table 2.

TABLE 2

| Additive | Maximum density | | | | | |
|---|---|---|---|---|---|---|
| | Developer I | | | Developer II | | |
| | Yellow | Magenta | Cyan | Yellow | Magenta | Cyan |
| No additive | Type | Type | Type | Type | Type | Type |
| BHMCH | +18% | +20% | +24% | +7% | +9% | +5% |

We claim:

1. A bath composition for color development of color photographic materials having at least one light-sensitive silver halide emulsion comprising a photographic color coupler that forms a dye on becoming coupled with the oxidation product of the developer, which bath composition contains a development accelerator and at least one developer compound based on p-phenylenediamine series wherein the improvement comprises the bath composition contains at least one accelerator compound corresponding to the following general formula:

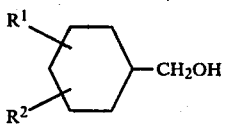

in which $R^1$ represents OH or $—CH_2—OH$ $R^2$ represents H, or $CH_3$ when $R^1=OH$.

2. A bath composition as claimed in claim 1 wherein said accelerator compound corresponds to the following structural formula:

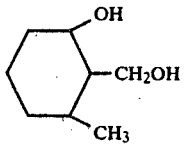

3. A bath composition as claimed in claim 1 wherein said accelerator compound corresponds to the following structural formula:

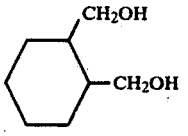

4. A bath composition as claimed in claim 1 wherein said accelerator compound corresponds to the following structural formula:

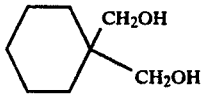

5. A bath composition as claimed in claim 1 wherein said accelerator compound corresponds to the following structural formula:

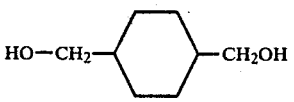

* * * * *